United States Patent [19]

Weinerman et al.

[11] Patent Number: 4,838,056

[45] Date of Patent: Jun. 13, 1989

[54] LATCH AND LOCK ASSEMBLIES WITH EXPANSIBLE LATCH ELEMENTS

[75] Inventors: Lee S. Weinerman, Medina; Steven A. Mayo, Akron, both of Ohio; Thomas V. McLinden, Oxford; Timothy H. Wentzell, South Windsor, both of Conn.

[73] Assignee: The Eastern Company, Cleveland, Ohio

[21] Appl. No.: 72,250

[22] Filed: Jul. 10, 1987

Related U.S. Application Data

[63] Continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[4] ..... E05B 13/10

[52] U.S. Cl. ..... 70/208; 70/210; 70/83; 70/209; 292/227; 292/228; 292/DIG. 31

[58] Field of Search ..... 70/81, 83, 84, 209, 70/208, 431, 451, 466, 489, 483–485; 292/198, 164, 210, 224, 227, 228, 240, 242, DIG. 31, DIG. 37, DIG. 63

[56] References Cited

U.S. PATENT DOCUMENTS

| | | | |
|---|---|---|---|
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 1,995,106 | 3/1935 | Roedding | 292/227 X |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 4/1985 | Ahad | 70/208 |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,900,204 | 8/1959 | Pelcin | 292/173 |
| 2,916,905 | 12/1959 | Podlesak | 70/150 |
| 2,952,150 | 9/1960 | Matzkin et al. | 70/451 |
| 2,962,320 | 11/1960 | Gilbert | 70/451 X |
| 2,987,908 | 6/1961 | Pelcin | 70/146 |

(List continued on next page.)

OTHER PUBLICATIONS

Southco Inc., *Southco Fasteners Handbook* 37, Concordville, PA 19331, date unkown.

Eberhard Manufacturing Co., *Handbook of Latches, Locks, Hinges, Handles, and Related Hardware,* No. 103, Cleveland, OH 44136, 1985.

Adams Rite Manufacturing Co., *Hardware For Glass Doors That Swing or Slide,* City of Industry, CA 91749, Jan. 1988.

POP Fasteners Division, Emhart Fastener Group, Emhart Corp., *Well-Aid Threaded Inserts,* (4 page brochure), Shelton, CT 06484, Nov. 1983.

*Primary Examiner*—Gary L. Smith
*Assistant Examiner*—Suzanne L. Ding
*Attorney, Agent, or Firm*—David A. Burge

[57] ABSTRACT

Flush mountable latches and locks for industrial cabinets, tool carts, electrical equipment enclosures and the like utilize versatile housings of novel configuration together with pivotally nestable and extensible handles that are movable relative to their housings to effect latching and unlatching movements of a resilient, expansible latch member. Locking mechanisms are mountable on the housings to selectively permit and prevent unlatching movements of the latch member. The resulting arrangement provides sturdy latch and lock assemblies that employ a small number of relatively movable parts that can be assembled and serviced with ease.

34 Claims, 7 Drawing Sheets

U.S. PATENT DOCUMENTS

| | | | |
|---|---|---|---|
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/208 X |
| 3,209,563 | 10/1965 | Pelcin | 70/146 |
| 3,209,564 | 10/1965 | Pelcin | 70/148 |
| 3,338,610 | 8/1967 | Pelcin et al. | 292/126 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/DIG. 31 X |
| 3,550,412 | 12/1970 | Pitel et al. | 70/208 X |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 292/228 X |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 292/DIG. 31 X |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 292/DIG. 31 X |
| 4,492,394 | 1/1985 | Dignan | 292/64 |
| 4,498,319 | 2/1985 | Balducci et al. | 70/489 X |
| 4,510,779 | 3/1955 | Tatom | 292/DIG. 31 X |
| 4,578,968 | 4/1986 | Messier, Jr. | 70/208 |
| 4,671,547 | 6/1987 | Weinerman et al. | 292/197 |
| 4,676,081 | 6/1987 | Craig | 292/DIG. 31 X |
| 4,679,835 | 7/1987 | Weinerman et al. | 292/197 |
| 4,683,736 | 8/1987 | Weinerman et al. | 70/208 |
| 4,693,503 | 9/1987 | Bisbing | 292/DIG. 31 X |
| 4,706,478 | 11/1987 | Swan et al. | 70/208 |
| 4,707,006 | 11/1987 | Garg et al. | 292/DIG. 31 X |

LATCH AND LOCK ASSEMBLIES WITH EXPANSIBLE LATCH ELEMENTS

The present application is a continuation-in-part of co-pending application entitled CABINET LOCK WITH RECESSED HANDLE, Ser. No. 859,194 filed Apr. 28, 1986 by Lee S. Weinerman et al as a continuation-in-part of application Ser. No. 601,648 filed Apr. 18, 1984 (now abandoned), which applications are referred to hereinafter as the "Parent Cases," the disclosures of which are incorporated herein by reference. Application Ser. No. 859,194 issued Aug. 4, 1987 as U.S. Pat. No. 4,683,736.

CROSS-REFERENCE TO RELATED APPLICATIONS

Reference is made to the following related, concurrently-filed applications, the disclosures of which are incorporated herein by reference:

LATCH AND LOCK HOUSINGS, HANDLES AND MOUNTING BRACKETS, Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

LATCH AND LOCK ASSEMBLIES WITH SPRING-BIASED SLIDE BOLTS, Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

LATCH AND LOCK ASSEMBLIES WITH SPRING-BIASED PIVOT BOLTS, Ser. No. 072,174, filed July 10, 1987 by Lee S. Weinerman, Steven A. Mayo, Thomas V. McLinden and Timothy H. Wentzell, hereinafter referred to as the "Utility Case III;"

LATCH AND LOCK ASSEMBLIES WITH LIFT AND TURN HANDLES, Ser. No. 072,175, filed July 10, 1987 by Lee S. Weinerman, Frank R. Albris, Thomas V. McLinden and Timothy H. Wentzell, hereinafter referred to as the "Utility Case IV;"

HOUSINGS FOR LATCHES AND LOCKS, Ser. No. 072,282, filed July 10, 1987 by Richard H. Russell, David W. Kaiser and Richard M. O'Grady, hereinafter referred to as the "Design Case I;"

COMBINED HOUSINGS AND HANDLES FOR LATCHES AND LOCKS, Ser. No. 072,283, filed July 10, 1987 by Richard H. Russell, David W. Kaiser and Richard M. O'Grady, hereinafter referred to as the "Design Case II;"

COMBINED HOUSINGS AND HANDLES FOR LATCHES AND LOCKS, Ser. No. 072,285, filed July 10, 1987 by Richard H. Russell and David W. Kaiser, hereinafter referred to as the "Design Case III;"

COMBINED HOUSINGS AND HANDLES FOR LATCHES AND LOCKS, Ser. No. 072,284, filed July 10, 1987 by Richard H. Russell and David W. Kaiser, hereinafter referred to as the "Design Case IV;"

COMBINED HOUSINGS AND HANDLES FOR LATCHES AND LOCKS, Ser. No. 072,286, filed July 10, 1987 by Richard H. Russell and David W. Kaiser, hereinafter referred to as the "Design Case V;"

COMBINED HOUSINGS AND HANDLES FOR LATCHES AND LOCKS, Ser. No. 072,253, filed July 10, 1987 by Richard H. Russell and David W. Kaiser, hereinafter referred to as the "Design Case VI;"

COMBINED HOUSINGS AND HANDLES FOR LATCHES AND LOCKS, Ser. No. 072,277, filed July 10, 1987 by Richard H. Russell and David W. Kaiser, hereinafter referred to as the "Design Case VII;"

MOUNTING BRACKETS FOR LATCHES AND LOCKS, Ser. No. 072,278, filed July 10, 1987 by Richard H. Russell and Thomas V. McLinden, hereinafter referred to as the "Design Case VIII;"

MOUNTING BRACKETS FOR LATCHES AND LOCKS, Ser. No. 072,280, filed July 10, 1987 by Richard H. Russell and Thomas V. McLinden, hereinafter referred to as the "Design Case IX;"

STRIKERS FOR USE WITH LATCHES AND LOCKS, Ser. No. 072,279, filed July 10, 1987 by Lee S. Weinerman and Steven A. Mayo, hereinafter referred to as the "Design Case X;" and, STRIKERS FOR USE WITH LATCHES AND LOCKS, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize a highly versatile housing together with other interactive components of novel form to provide desired types of latching and locking actions.

2. Prior Art

Flush mounted latches and locks including a body, a latch bolt movably carried on the body, and an operating handle that is nested by the body are well known. Normally the handle is in a flush or nested position when the bolt is in a latched position; and unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pat. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to the Eastern Comapny, a corporation of Connecticut.

Flush mounted latches and locks having latch bolts of other than the spring-projected, slide-mounted type are disclosed in such U.S. Pat. Nos. as 4,413,849, 4,320,642, 4,312,203, 4,134,281, 3,857,594, 3,338,610, 3,044,814, 3,044,287 and 2,735,706, all of which are assigned to the Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

A variety of proposals have been made in efforts to utilize resilient components of various types to provide latch members that are expansible once they have engaged a suitably configured retaining formation. Likewise, resilient, expansible shock mount members of various types have been proposed for resiliently coupling pairs of components in many types of applications. The use of resilient, expansible members to provide releasable mounts in applications where a "blind fastener" is needed also is known.

3. The Cross-Referenced Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is reflected in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Parent Cases

The referenced Parent Cases discloses a simple means for retaining a key cylinder assembly in a lock housing. The lock housing has a generally cylindrical opening formed therethrough that extends along an axis for mounting a key cylinder assembly for rotation about the axis. Axially extending grooves are formed in an internal wall that defines the cylindrical opening. One of the grooves (referred to as an "installation groove") extends rearwardly and opens through such rear wall portions of the housing as surround the cylindrical opening. The grooves serve the function of cooperating with key operated tumblers of the key cylinder assembly that project radially from opposed sides of the key cylinder assembly to selectively permit and prevent rotation of the key cylinder assembly relative to the housing. The installation groove serves the function of permitting an offset projection that is carried on the back of the key cylinder assembly to be inserted completely through the cylindrical opening of the housing as the key cylinder assembly is installed in the cylindrical opening. Once the key cylinder assembly is installed, it is rotated to position the offset projection out of alignment with the installation groove so that the offset projection extends in overlying relationship with such rear wall portions of the housing as surround the cylindrical opening in which the key cylinder assembly is installed. By this arrangement, so long as the key cylinder is prevented from rotating relative to the housing to a position where the offset projection aligns with the installation groove, the offset projection serves to retain the key cylinder assembly in place on the housing.

As will be explained in greater detail, the type of housing features that are described above, and that also are disclosed in the referenced Parent Cases, are utilized in the preferred practice of the present invention. For this reason, the present application is being filed as a continuation-in-part case, with the benefits of the filing dates of the referenced Parent Cases being claimed.

SUMMARY OF THE INVENTION

The present invention provides novel and improved flush mountable latches and locks for industrial cabinets, tool carts, electrical equipment enclosures and the like, with the latches and locks utilizing a highly versatile housing together with other interactive components of novel form to provide desired types of latching and locking actions.

A latch or lock embodying the preferred practice of the present invention includes a one-piece housing on which are mounted other interactive components that provide a variety of desired features. As will become apparent from the description that follows, the versatile housing that is used with latches and locks that embody the preferred practice of the present invention provides a rigid, sturdy base structure for securely supporting latch and lock components. Latches and locks that embody the preferred practice of the present invention advantageously employ small numbers of relatively movable parts that can be assembled and serviced with ease.

The versatile housing on which other operating components are mounted preferably is formed from a suitable thermoplastics material such as a glass reinforced polycarbonate based polymer blend, which provides a dimensionally stable, impact resistant structure that is rigid, strong and can be readily machined as may be needed to provide mounting formations for movably mounting operating handles of a wide variety of types. The molded housing defines a pan-shaped structure that has a forwardly facing recess for nesting an operating handle. A pair of threaded mounting studs have enlarged head portions that are embedded in the molded material of the housing so that the threaded studs project rearwardly from a back wall of the housing for receiving mounted posts that are threaded onto the studs for mounting latch and lock operating components, and for establishing connections with a mounting bracket.

A feature of the latch and lock units that embody the preferred practice of the present invention resides in their use of a pivotally mounted handle that is a component of a handle and shank assembly which is installed on the housing concurrently with a U-shaped bracket, with all of these components secured in place by tightening a single nut that threads onto a barrel of the handle and shank assembly. The U-shaped bracket engages the shank and restrains the shank against rotation; and, if the unit has a locking capability, to the bracket cooperates with a slidably mounted locking member to restrain the shank against both unwanted rotary movement and axial unlatching movement.

A further feature of latch and lock units that embody the preferred practice of the present invention resides in their use of an expansible latching member that provides something of a resilient, shock-mount type of connection between a structure on which the latch or lock assembly is mounted, and a structure on which a keeper is mounted that is engaged by the resilient latching member. The resilient, expansible latching member takes up play or slack that might otherwise permit unwanted vibration and rattling of loose parts in a vibration prevalent environment; cushions the mounting of the components that are releasably connected; prevents metal-to-metal contact of interengaged latch ports; and provides latches and locks that embody the preferred practice of the present invention with a very secure and desirable type of "feel" associated with their operation.

While latch and lock structures that embody the preferred practice of the present invention have latch members of the resilient, expansible type, not all of the features of the invention are limited to use with latches and locks that have resilient expansible latch members, as will be apparent to those skilled in the art from the description and claims that follow.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
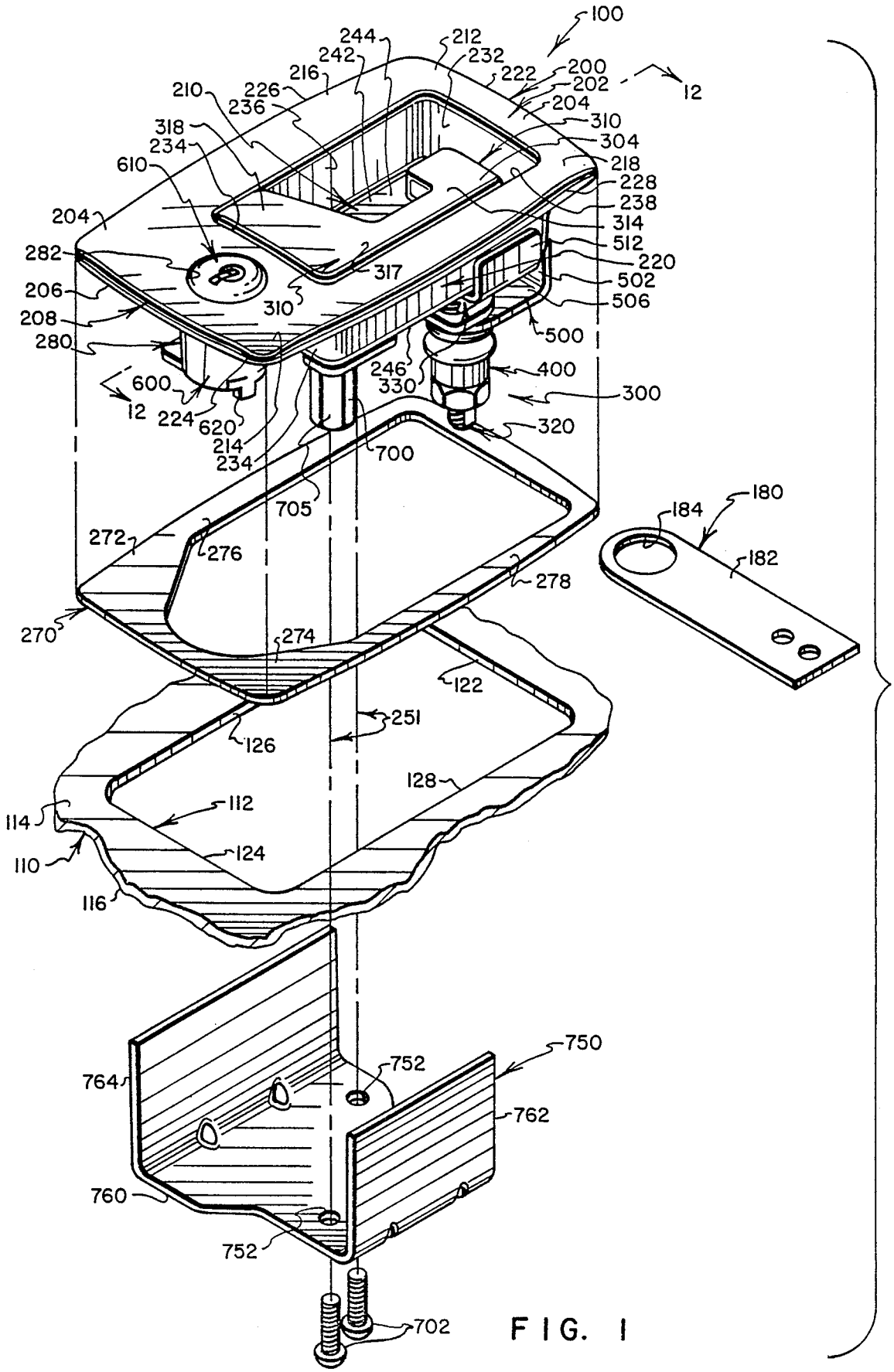
FIG. 1 is an exploded perspective view of one form of lock assembly that embodies features of the preferred practice of the present invention, illustrating how the lock assembly is mounted on a closure.
Figure 2:
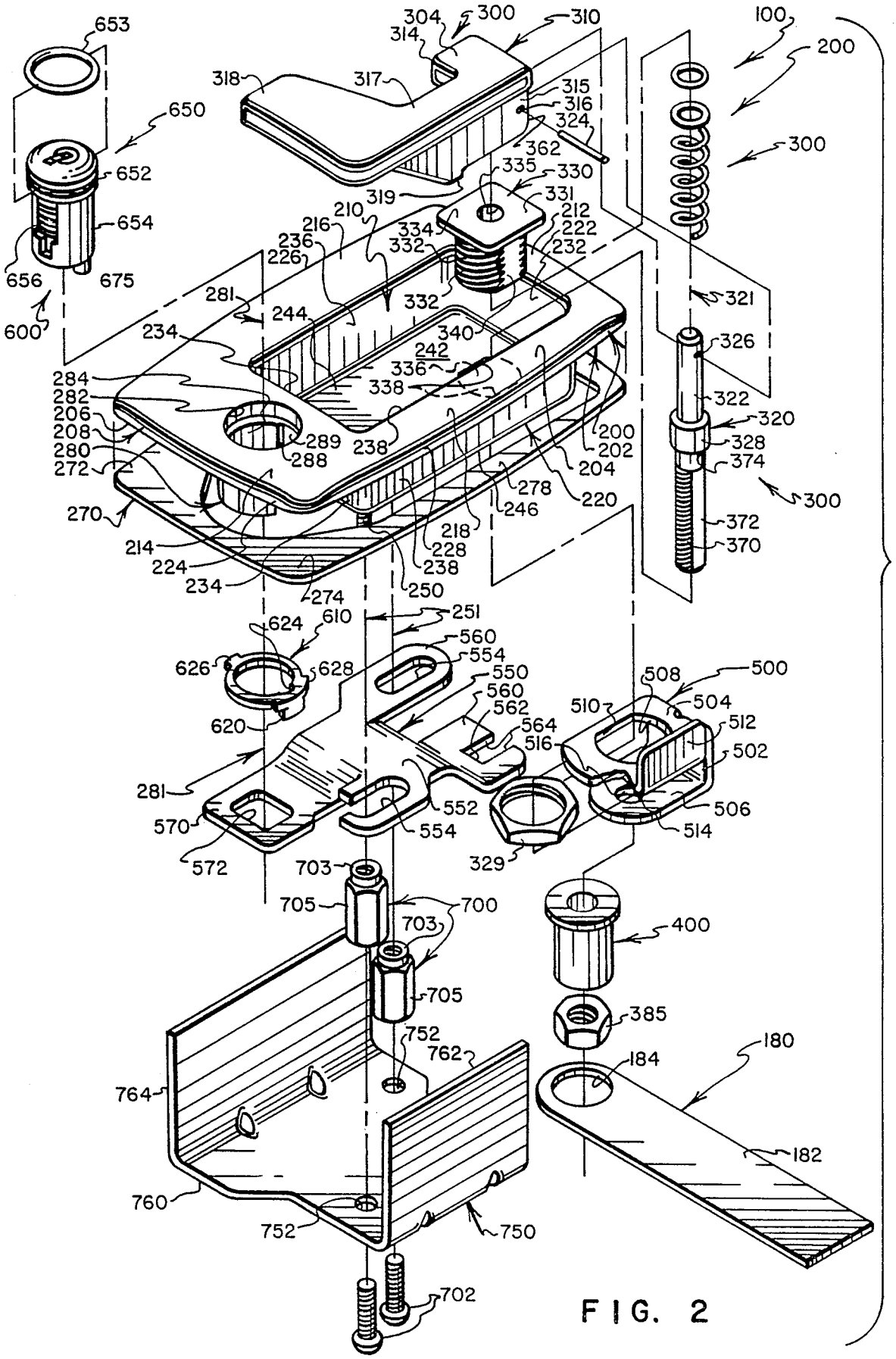
FIG. 2 is an exploded perspective view of components of the lock assembly of FIG. 1.

Referring to FIGS. 1 and 2, one form of a lock assembly that embodies features of the preferred practice of the present invention is indicated generally by the numeral 100. The lock assembly 100 has a housing 200 that mounts a plurality of interactive components that provide latching and locking functions. In preferred practice, the latch and lock components that are described below are formed either from a durable thermoplastics material that will be described, or from stainless steel, whereby the resulting latch and lock units can be utilized in most normal environments without special concern about deterioration from causes such as corrosion.

In overview, and as will be explained in greater detail, the interactive components that are carried on the housing 200 principally include a handle and shank assembly 300 including a handle 310 that is mounted on an elongate shank 320 that is journaled by a barrel 330, with the barrel 330 being rigidly connected to the housing 200, and with the handle 310 being movable relative to the housing 200 between normal and operating positions; a resilient, expansible latch member 400 that is mounted on the housing 200 for expansion and contraction movements between what will be referred to as "latched" (i.e., "expanded") and "unlatched" (i.e., "contracted") positions; a mounting bracket 500 that positions the resilient latch member 400 relative to the housing 200; and, a locking mechanism 600 for selectively permitting and preventing latching and unlatching (i.e., expansion and contraction) movements of the resilient latch member 400 by the handle 310. If the locking mechanism 600 is omitted, the lock assembly 100 is thereby transformed into a latch assembly, i.e., a unit which has a handle 310 that always can be operated to "latch" and "unlatch" the the resilient latch member 400.

Appearance features of the combined housing and handle (i.e., the housing 200 and the handle 310) are shown in greater detail in the referenced Design Case III.

Referring to FIG. 1, it will be seen that the resilient latch member 400 projects relatively rearwardly with respect to the housing 200 for engaging a suitably configured keeper 180 or other structure that is located adjacent the lock assembly 100 when a closure 110 (on which the lock assembly 100 is mounted) is "closed."

Figure 3:
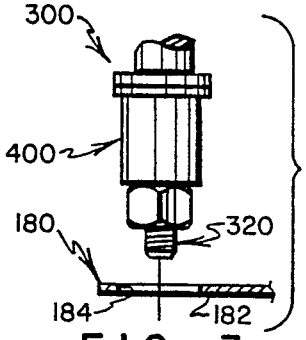
FIG. 3 is a schematic top plan view, showing portions of the lock assembly of FIG. 1 including a resilient latch member approaching a keeper that is shown in cross section.
Figure 4:
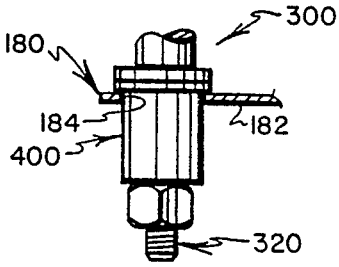
FIG. 4 is a schematic top plan view similar to FIG. 3, but with the resilient latch portion received in an opening that is formed through the keeper.
Figure 5:
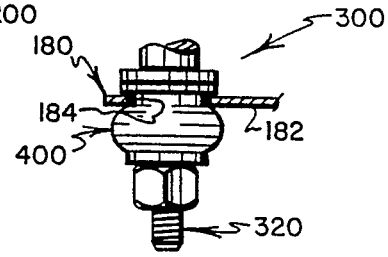
FIG. 5 is a schematic top plan view similar to FIG. 4, but with the resilient latch member in latched engagement with the keeper.
Figure 6:
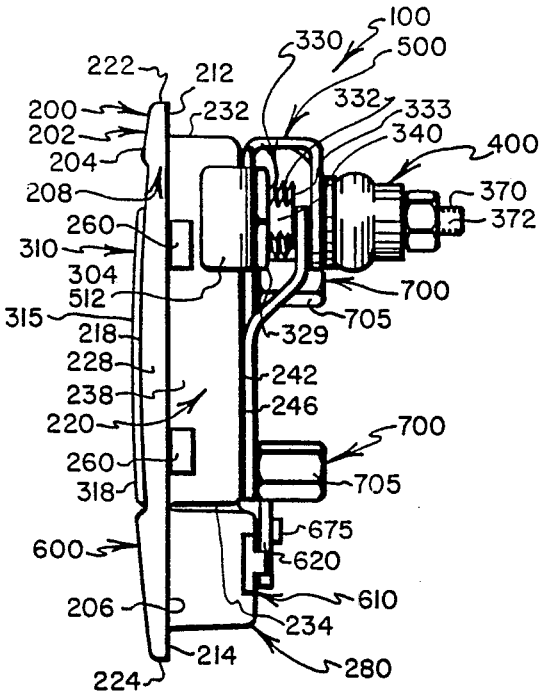
FIG. 6 is a right side elevational view thereof, with the handle in its normally nested position, with the resilient latch member "latched," and with locking components locked.

The keeper 180 has an elongate body structure 182 that surrounds and defines a latch-member receiving opening 184 that is of adequate size to receive a cylindrical body portion of the resilient latch member 400, and to releasably retain the resilient latch member 400 when the resilient latch member 400 has been expanded while extending through the opening 184. The manner in which the resilient latch member 400 engages, expands within, and contracts within the keeper opening 184 is illustrated in FIGS. 3–5.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. The closure portion 110 has a front surface 114 and a rear surface 116 that extends about the perimeter of the opening 112. The opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. Appearance features of the mounting bracket 750 are disclosed in greater detail in the referenced Design Case IX.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 270, to clamp the gasket 720 into engagement with the front surface 114, and to clamp the legs 762, 764 into engagement with the rear surface 116.

Figure 9:
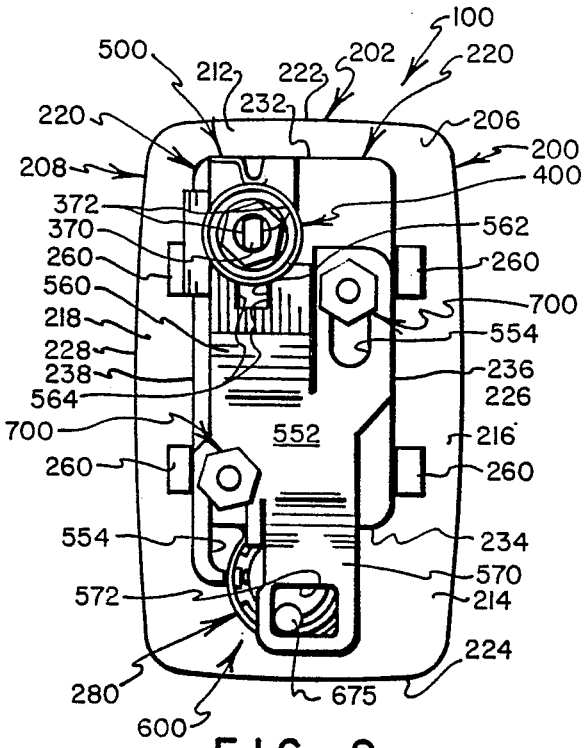
FIG. 9 is a rear elevational view similar to FIG. 7, but with locking components unlocked.
Figure 10:
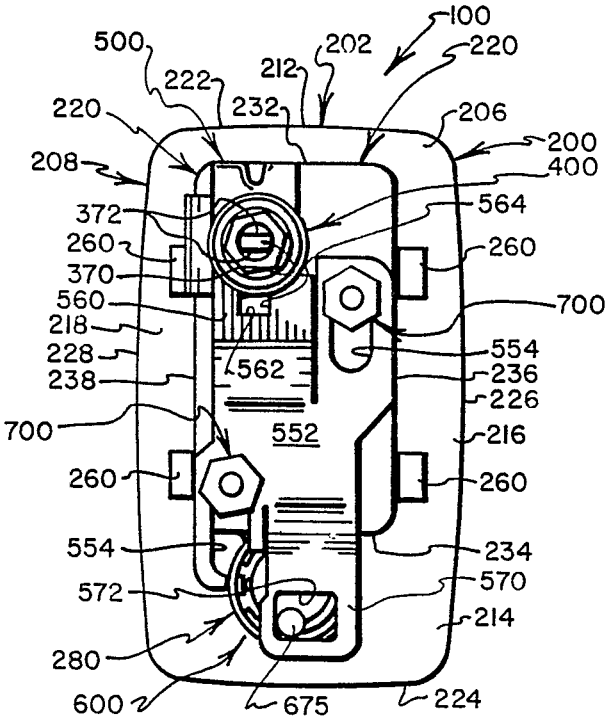
FIG. 10 is a rear elevational view similar to FIG. 9, but with the resilient latch member unlatched.

To facilitate an understanding of the various relative positions of the principal relatively movable components of the lock assembly 100, reference is made to FIGS. 1 and 2 wherein the handle 310 is in its "normal" or "nested" position; the resilient latch member 400 is in its "latched" or expanded position; and the lock mechanism 600 is "locked" so as to prevent unlatching movement of the resilient latch member 400 in response to attempted operation of the handle 310. In FIG. 9, the locking mechanism 600 of the lock 100 is shown "unlocked" so as to permit unlatching movement of the resilient latch member 400 by operation of the handle 310. In FIG. 10, the handle 310 is shown in its "operating" position wherein the handle 310 functions (in conjunction with the operation of other components, as will be described) to move the resilient latch lement 400 to its "unlatched" or contracted position.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, MA 01201 under the registered trademark XENOY. The most preferred resin blend is about 10 percent glass reinforced, and is selected from the "6000 Series" of the XENOY products sold by General Electric, with XENOY 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

The mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important functions of mounting and guiding the movement of other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decrease progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the position of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparsion with the relatively tall height of the bottom wall portion 214 that depends beneath the recess 210, and results in the left sidewall portion 216 being relatively wide, while the right side wall portion 218 is relatively narrow.

Several functional features of the housing 200 are arranged substantially symmetrically about the center plane 201, including the side walls 236, 238 of the housing portion 220, and a sleeve-like housing formation 280, which will be described. With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Figure 14:
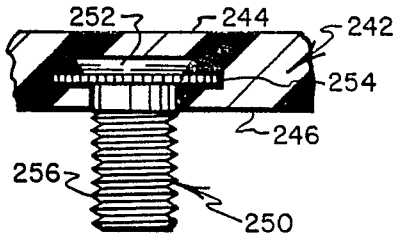
FIG. 14 is a sectional view as seen from a plane indicated by a line 14—14 in FIG. 11; and, FIG. 15 is an exploded perspective view showing selected portions of the lock assembly with the view showing principally rear features thereof.

Threaded studs 250 project rearwardly from the rear face 246 of the back wall 242 for mounting various latch and lock components, as will be explained. Referring to FIG. 14, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the material of the plastic and will not rotate with respect thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extnd coaxially through the holes 752 that are formed in the back wall 760 of the mounting bracket 750. The axes 251 of the studs 250 are located equidistantly from the center plane 210, and are positioned on opposite sides of the center plane 201.

In preferred practice, the threaded studs 250 are commercially available fasteners that are sold by Penn Engineering and Mfg. Corp. of Danboro, PA, under the trademark PEM. The preferred part is model number CHN-832-4, is formed from stainless steel, has a tapered head 252 with a maximum diameter of about 0.289 inch, has radially extending projections portions 254 with a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Figure 7:
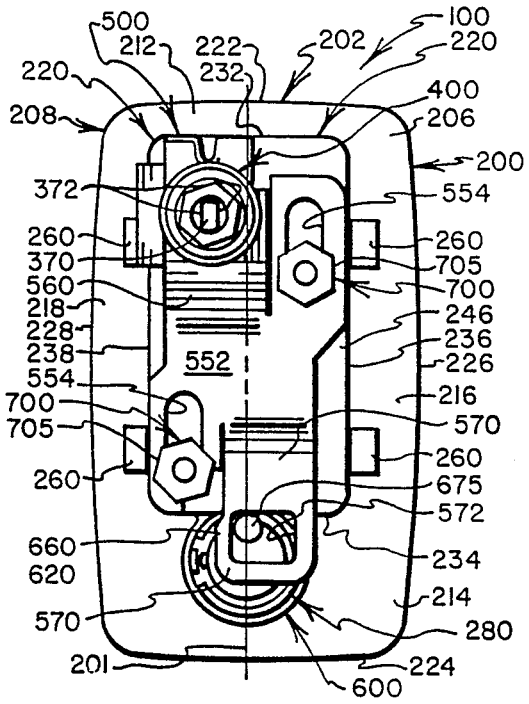
FIG. 7 is a rear elevational view thereof.
Figure 8:
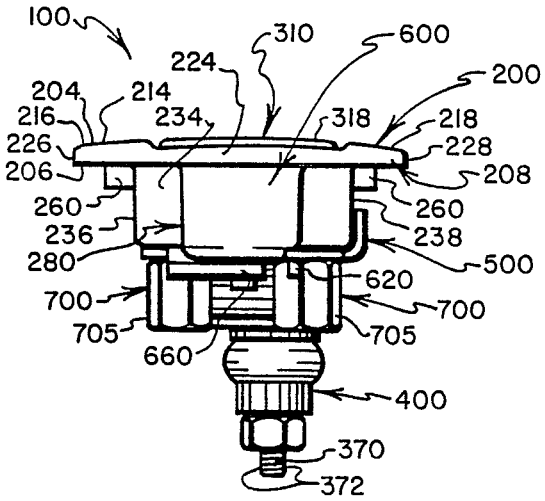
FIG. 8 is a bottom plan view thereof.

Locator projections 260 are provided at spaced locations along the side walls 236, 238 at junctures of the side walls 236, 238 with the rear face 206 of the mounting flange 202. As will be seen in FIG. 7, the locator projections 260 are arranged symmetrically in pairs on opposite sides of the center plane 201. The locator projections 260 are intended to directly engage opposite sides 126, 128 of the opening 112 to orient the lock assembly 100 properly on the closure 110; however, if the opening 112 has been formed so as to be slightly "oversized," the locator projections 260 may be utilized during installation of the lock assembly on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

While the gasket 270 is not essentially in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside-out" manner. Specifically, referring to FIGS. 1 and 2, the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large, generally triangular-shaped corner region 272 that is configured to underlie a correspondingly large corner portion of the bottom wall 214 of the mounting flange 202, and a relatively smaller, generally triangular shaped corner region 274 that is configured to underlie a correspondingly smaller corner portion of the bottom wall 214 of the mounting flange.

The sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 (see FIG. 2) that lies within the imaginary center plane 201 and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figure 15:
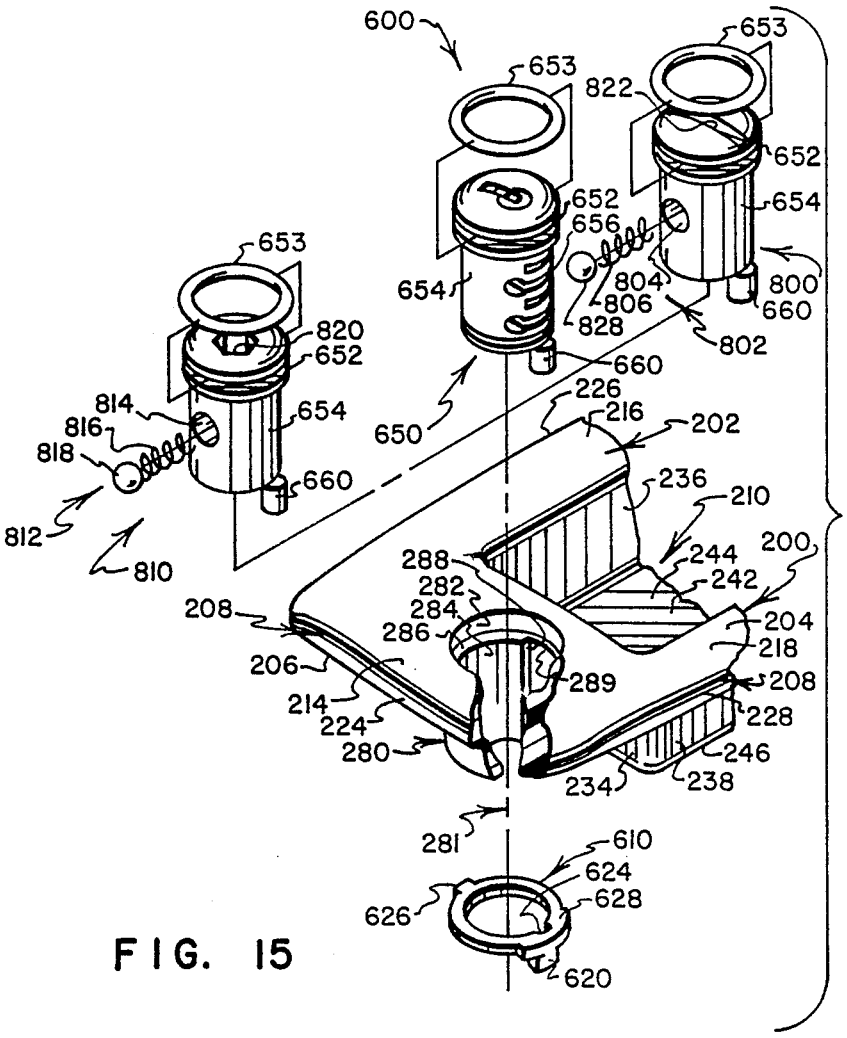
Figure 16:
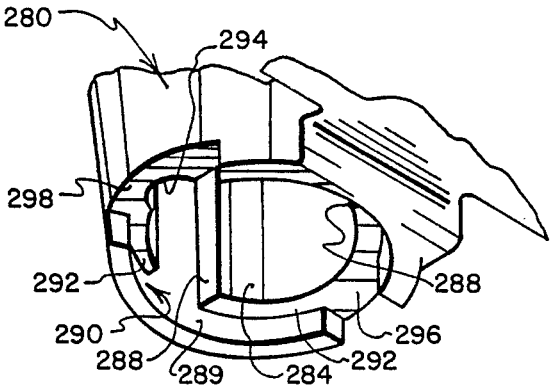

Referring to FIGS. 15 and 16, features of the sleeve formation 280 are shown. The sleeve 280 has a shoulder 286 that extends substantially radially with respect to the axis 281 to form a transition between the relatively large diameter of the opening 282 and the relatively smaller diameter of the passage 284. Axially extending top and bottom grooves 288 are formed in opposed upper and lower portions of the passage 284. The grooves 288 extend axially rearwardly from the shoulder 286 and have bottom walls 289 that are curved and represent continuations of a cylindrical surface 290 of enlarged diameter that is formed in the rearward end region of the sleeve 280. Referring to FIG. 16, a radially extending shoulder 292 forms a transition between the passage diameter that is designated by the numeral 284, and the enlarged diameter end region 290. A round installation groove 294 of shallower depth than the grooves 288 is formed in a side of the passage portion 284. The rounded installation groove 294 extends from the shoulder 286 to the shoulder 292.

Referring to FIG. 16, two opposed portions 296, 298 of the shoulder 292 extend radially outwardly and interrupt opposed side portions of the sleeve formation 280 to provide radially extending, rearwardly opening notches that are designated by the numerals 296, 298.

In preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. By this arrangement, a wide variety of types of handles as well as latch and lock components of various forms may be utilized with the housing, as is illustrated and described in the reference Utility and Design cases. Depending on the type of handle that is to be used with the housing 200, and on the type of latch or lock operating mechanism that is to be mounted on the housing 200, one or more suitable passages through the housing 200 are machined in the form of openings, holes, slots and the like which are formed as by drilling, milling or other conventional machining techniques.

For purposes of mounting the handle and shank assembly 300 on the housing, a single hole 336 is formed through the back wall 242 of the housing 200, with opposite sides of the hole 336 having flat surface formations 338 for mating with similarly configured flat surface portions formed on a threaded exterior surface of the barrel 330 to prevent rotation of the barrel 330 relative to the housing 200, as will be explained.

The handle 310 is formed from molded plastics material, preferably of the same thermoplastics material from which the housing 200 is formed. The handle 310 has a front surface 304 that is of complexly curved, generally convex shape, and is configured to extend in a flush, substantially contiguous manner to smoothly continue the curvatuve of the complexly curved, convex front surface 204 of the mounting flange 202 when the handle 310 is in its normal or nested position. The handle 310 is mounted on the housing 200 for movement between a normally nested position that is, shown in FIGS. 1 and 12, and an operating position that is depicted in FIGS. 13.

The handle 310 has an end region 312 that defines a mounting formation 314 that is pivotally connected to the elongate shank 320 by a roll pin 324. The roll pin 324 extends through aligned holes 316 that are formed through spaced side parts 315 of the mounting formation 314, and through a hole 326 that is formed in a front end region 322 of the elongate shank 320. The mounting formation 314 receives the front end region 322 of the shank 320 between its side parts 315. The holes 316 that are formed in the spaced side parts 315 of the mounting portion 314 receive opposed end regions of the roll pin 324 in a press fit. The shank hole 326 receives the pin 324 in a slip fit, whereby the pin 324 (and the handle 310 to which the pin 324 is rigidly connected) is free to pivot relative to the shank 320.

The handle 310 has a front surface 304 that is complexly curved to conform to the complexly curved configuration of the front face 204 of the housing 200. The front surface 304 overlies the front end region 322 of the shank 320 and extends away from the shank 320 to provide an L-shaped handle portion that includes a narrow connections leg 317 that connects with a relatively wider leg 318 that can be engaged and grasped by an operator to move the handle 310 between its nested and operating positions. A stop formation 319 is formed on the connecting leg 317 for engaging the housing back wall 242 when the handle 310 is nested, as is best seen in FIGS. 11 and 12.

Figure 11:
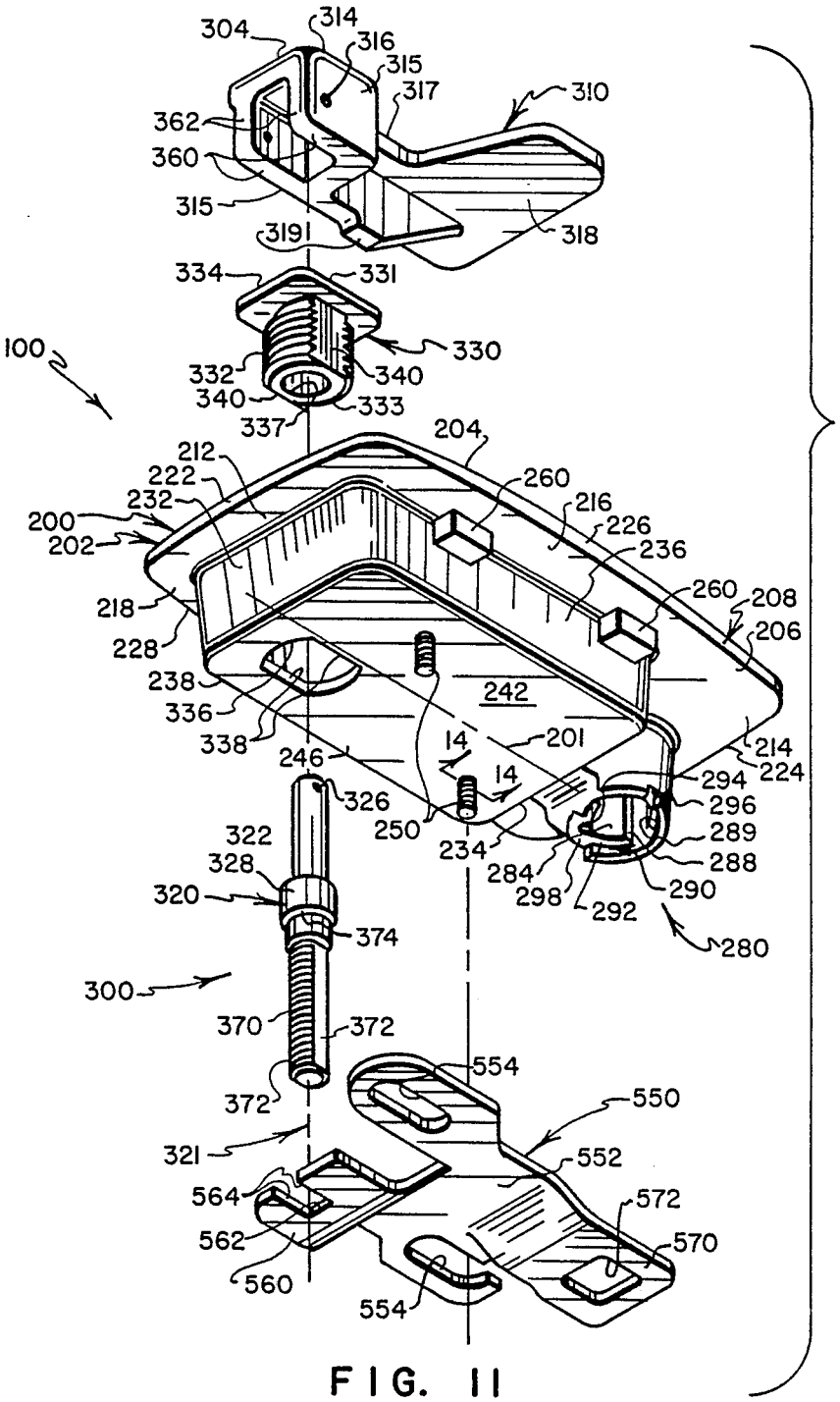
FIG. 11 is an exploded perspective view showing selected portions of the lock assembly with the view showing principally rear features thereof.

Referring to FIGS. 2 and 11, the barrel 330 has a threaded body 332 with an enlarged, generally rectangular head 334 formed at its front end. A front surface 331 is provided on the head 339. An end surface 333 is provided on the threaded body 332. Flat surfaces 340 are provided on opposite sides of the threaded body 332. The hole 336 that is formed through the back wall 242 of the housing 200 is sized and configured to closely receive the threaded body 332 of the barrel 330, with the opposed flat surfaces 340 that are provided on the barrel 330 extending closely alongside the flat surface formations 338 of the housing hole 336.

Figure 12:
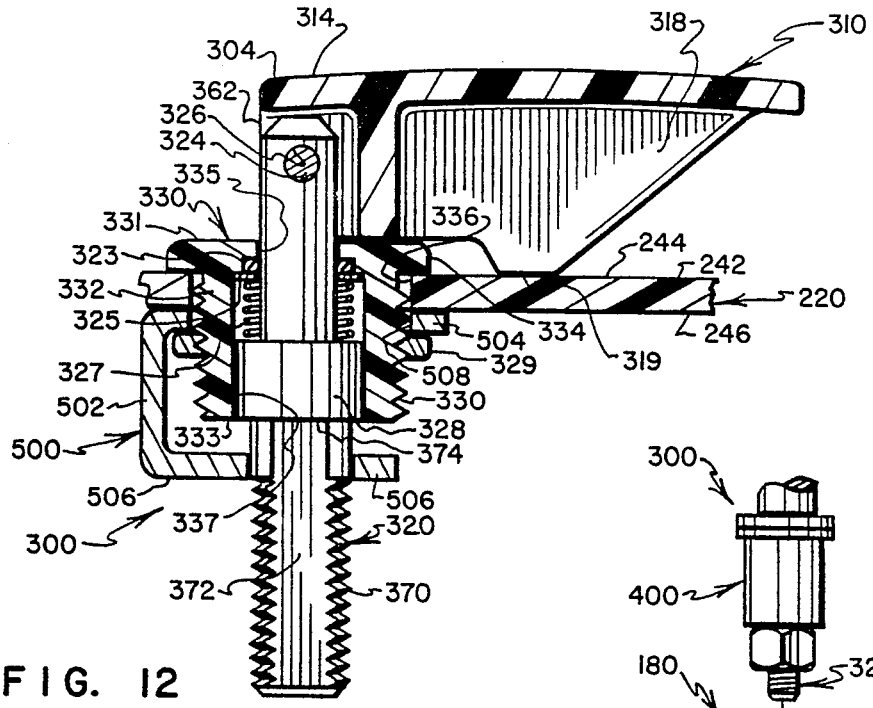
FIG. 12 is a sectional view, on an enlarged scale, showing portions of the lock's handle in its nested position; as seen from a plane indicated by a line 12—12 in FIG. 1.
Figure 13:
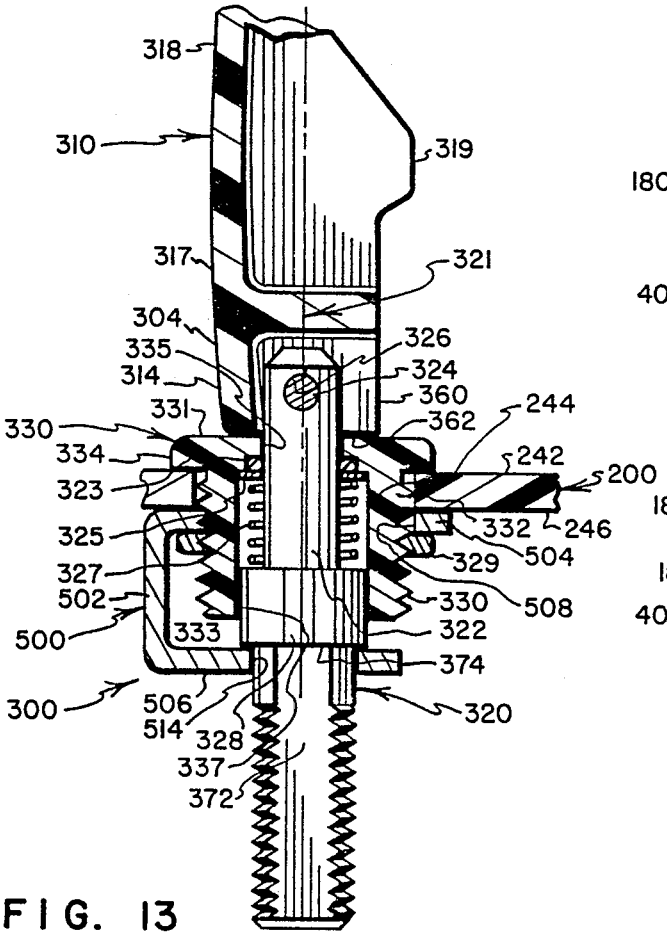
FIG. 13 is a sectional view similar to FIG. 12, but showing the handle in its operating position.

Referring FIGS. 12 and 13, a relatively small diameter hole 335 is formed through the head 331. A relatively large diameter hole 337 is formed through the body 332. The barrel 330 houses and O-ring seal 323, a washer 325, and a compression coil spring 327 that acts on the washer 325 and on an enlarged diameter portion 328 of the shank 320. The spring 327 biases the shank 320 rearwardly with respect to the housing 200 toward the position depicted in FIG. 13.

Referring to FIGS. 11–13, the mounting portion 314 of the handle 310 defines stop surfaces 360, 362 that extend at right angles for engaging the front of the barrel 330 when the handle 310 is in its nested and operating positions, respectively. The stop surface 360 is formed on the upper end region of the mounting formation 314 of the handle 310 for engaging the front 331 of barrel 330 when the handle 310 is in its nested position, as is shown in FIG. 12. The stop surface 362 is formed on an adjacent edge of the mounting formation 314 and serves to engage the front 331 of the barrel 330 when the handle 310 is in its operating position, as is shown in FIG. 13.

Referring to FIGS. 2 and 11–13, the threaded portion 370 of the shank 320 extends rearwardly from the central, relatively large diameter portion 328 and has opposed flats 372 formed on opposite sides thereof. When the handle 300 is nested, a central portion 328 of the shank 320 is housed within the confines of the barrel 330, with a shoulder 372 at the rear end of the central portion 328 extending flush with the barrel end 331. A locking member 550 has a notch 552 that can be slided into locking engagement with flats 372 to prevent rotation, of the handle 300; and with the locking member portion 552 closely underlying the central portion 328 of the shank 320, the central portion 328 of the shank 320 is prevented from moving rearwardly out of the barrel 330 (i.e., rearwardly beyond the barrel end surface 331) whereby the locking member 550 prevents rearward movement of the shank 320.

The relative arrangement of the locking member 550 and the shank 320 is depicted most clearly in FIG. 11. The locking member 550 has a central portion 552 that carries mounting slots 554, and has rearwardly offset portions 560, 570 on opposite end regions thereof. The offset portion 560 carries a notch 552 that has opposed side walls 654 that are engageable in a slip fit with opposed flats that are formed on the shank 320, to thereby prevent rotary movement of the shank 320 and the handle 310. Moreover, the offset portion 560 defines a forwardly facing surface 556 that is engageable with a shoulder that is formed on the shank 320 to prevent rearward axial movement of the shank 320 (and hence unlatching movement of resilient latch member 400).

The slots 554 receive the threaded stud 250; additionally the mounting posts 700 have reduced diameter end regions 703 that extend into the slots 554. By this arrangement, the locking member 550 is mounted for linear sliding engagement along the housing back wall 242.

The offset portion 570 has a rectangular opening 572 that engages an offset projectio 675 that is carried on the lock cylinder 650 so as to move the locking member between locked and unlocked positions in response to operation of the lock cylinder 650 to rotate the projection 675 within a 180 degree range of travel. The opening 572 is of a size that prevents the offset projection 675 from rotating to a position of alignment with the installation grooves 624, 294—whereby the locking member 550 also serves the function of retaining the locking plug 650 in the housing 200.

A U-shaped bracket 500 is mounted on the housing 200. The bracket 500 has a central leg 502 that connects a pair of spaced, parallel extending legs 504, 506. The front leg 504 has a hole 508 formed through it to receive the threaded portion of the barrel 330. The hole 508 has flat surfaces 510 on opposite side portions that engage the opposed flats on the barrel 330. A forwardly extending side wall 512 is connected to the front leg 504 and extends along the side wall 238 of the housing portion 220. The rear leg 506 has a hole 514 formed therethrough to receive the threaded shank portion, with the hole 514 having opposed flat side surfaces 516 that engage the flats that are formed on opposite sides of the threaded end region of the shank 320.

The bracket 500 is held in place on the housing 200 by a stainless steel nut 520 that is threaded onto the barrel 330 and is tightened in place to clamp the barrel head 334 against the front surface 244 of the back wall 242, and to clamp the front leg 504 of the bracket 500 into firm engagement with the back surface 246 of the back wall 242.

The resilient latch member 400 is a commercially available shock mount component of the type that is designed to be inserted through an opening to serve as a blind-mount expansible anchor. A preferred commercially available part is sold under the trademark WELL-NUT by the POP Fasteners Division of Emhart Fastener Group, Shelton, CT 06484, with the most preferred model being designated by the number $\frac{1}{4}$-S, having a head diameter of about $\frac{5}{8}$ inch, a body diameter of about $\frac{1}{2}$ inch, an overall length of about $\frac{5}{8}$ inch, a grip range of about 0.015 to 0.111 inch, and having a standard $\frac{1}{4}$ 20NC internal thread to receive the threaded end region 370 of the shank 320. A nylon locking nut 385 is threaded onto the threaded end region 370 of the shank 320 and is tightened into engagement with the resilient latch member 400 to prevent relative rotation between the shank 320 and the resilient latch member 400.

The lock mechanism 600 includes a key cylinder 650 that is installed in the sleeve structure 280 of the housing 200 for slidably moving a locking member 550 between locked and unlocked positions for selectively permitting and preventing the handle 310 from axially moving the shank 320 to effect latching and unlatching movements of the resilient latch member 400.

The lock mechanism 600 includes a ring-like insert 610 that is provided for positioning in the rear end region 292 of the sleeve portion 280 of the housing 200. The insert 610 serves the function of closing rear end regions of the top and bottom grooves 288.

In order to provide an extension of the rounded installation groove 294 through the right-like insert 610, a rounded groove 624 is formed in the insert 610 and is aligned with the rounded groove 294 of the sleeve members 280. In order to properly align the right-like insert 610 for mounting on the housing 200 a pair of radially extending formations 626, 628 are provided to engage the grooves 296, 298 that are formed at the rear end of the sleeve members 280. The groove 296 and the formation 696 are of relatively small size and are configured to mate in a close slip fit. The groove 298 and the formation 698 are of relatively larger size and are configured to mate in a close slip fit. The difference in sizes of the mating components 296, 626 and 298, 628 prevents inadvertent switch mating of these similarly configured parts. The positioning of the relatively larger formation 628 as well as the rearwardly extending projection 620 at locations adjacent the area of the ring-like insert 610 that is structurally weakend by the provision of the rounded groove 624 serves to strengthen this area of the ring-like insert 610.

Referring to FIGS. 2, and 15, a key-receiving, tumbler-carrying plug assembly 650 is provided that has an enlarged diameter head portion 652 and a smaller diameter body 654 that are configured to be rotatably received in the opening and passage 282, 284 respectively. Radially extensible tumblers 656 form components of the plug 650 assembly and are extensible into the top and bottom grooves 288 to selectively permit and prevent rotation of the key cylinder assembly 650 with respect to the housing 200.

An offset cylindrical formation 675 is provided at the rear of the assembly 675 for engaging a back face of the insert member 610 to hold the cylinder assembly 650 in place in the housing 200. The plug assembly 650 is insertable into the sleeve 280 by inserting an appropriately configured key to retract the tumblers 656, and by aligning the offset cylindrical formation 675 with the groove 288 to move through the sleeve 280 to a position behind the insert 610. The plug 650 is retained in place on the housing 200 by preventing the offset cylindrical formation 675 from rotating to a position of alignment with the groove 294 (at which position the key cylinder assembly 650 could be removed).

If desired, the key locking cylinder assembly 650 can be replaced by tool operated plugs, as designated by numerals 800, 810 in FIG. 15. The plugs 800, 810 are shaped like the plug 650 and are insertable into the sleeve 280 in the manner described, with offset projections 675 aligned with the grooves 294, 624. The head portions of the plugs 800, 810 have circumferentially extending grooves 652 for carrying O-rings 653. Detent devices 802, 812 are preferably provided in the plugs 800, 810 as by forming radially extending bores 804, 814 that house springs 806, 816 and balls 808, 818. The balls 808, 818 are biased radially outwardly by the springs 806, 816 and cooperate with the grooves 288, 294 to prevent undesired rotation of the plugs 800, 810 and to give the operation of the locking plugs 800, 810 a good "feel."

The plugs 800, 810 carry tool receiving formations, typically a hex recess 820 for receiving an Allen wrench, or a narrow, shallow slot 822 for receiving a screwdriver.

To the extent that orientation terms such as "frontwardly," "rearwardly," "upwardly," "downwardly" and the like have been used in this document, it will be understood that such terms have been used similarly for convenience and to facilitate understanding of the features that have been described, whereby the use of such orientation term should not be deemed to limit the scope of the claims that follow.

Although the invention has been described in its preferred form with a certain degree of particularity, it is understood that the present disclosure of the preferred form has been made only by way of example, and that numerous changes in details of construction as well as the combination and arrangement of parts may be made without departing from the spirit and scope of the invention as hereinafter claimed. It is inteneded that the patent shall cover by suitable expression in the appended claims, whatever features of patentable novelty exist in the invention disclosed.

What is claimed is:

1. A flush-mountable latch having a resilient, expansible latch member that is insertable into a receiving formation of a keeper and is expansible and contractible after being inserted therein to selectively establish latching engagement between the latch member and the keeper, comprising:

(a) housing means including a pan-shaped housing having a front wall, and having recess-defining wall formations that define a forwardly facing recess, with portions of the front wall forming a mounting flange that surrounds the recess;

(b) the housing being formed as a rigid, one-piece molded structure with the recess-defining wall formations including a back wall at the rear of the recess, with the back wall defining a rearwardly facing mounting surface;

(c) threaded fastener means rigidly connected to the back wall at spaced locations;

(d) handle means including a handle connected to the housing and being pivotally movable relative to the housing between a non-operated position and an operated position;

(e) opening means formed through the recess-defining wall formations of the housing to establish a path of communication between the forwardly facing recess and a region that is located behind the back wall, including an opening formed through the back wall;

(f) handle-connected means extending through the opening means for connection to the handle and having a portion that extends into said region located behind the back wall for being moved within said region in response to movement of the handle between its non-operated and operated positions, including an elongate shaft-like shank that is connected to the handle and extends through the back wall and that is connected to the housing for axial movement along the axis of the shank in response to pivotal movement of the handle; and (g) resilient, expansible latch means including a resilient, expansible latch member that has a latching formation having first and second portions that are movable relatively toward and away from each other to effect expansion and contraction of the latch member, with the first of the relatively movable portions being connected to the housing means, and with the second of the relatively movable portions being connected to the shank for movement toward and away from the first of the relatively movable portions in response to movement of the shank in response to movement of the handle between its non-operated and operated positions to effect expansion and contraction of the latching formation in response to handle movement, and with the latching formation being insertable into a receiving formation that is defined by a keeper, with the latching formation being selectively expansible and contractible after being inserted into the receiving formation to releasably grip the keeper so as to selectively establish and release latching engagement with the keeper in response to said movement of the handle between its non-operated and operated positions.

2. The latch of claim 1 wherein the front wall has a front surface that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

3. The latch of claim 2 wherein the handle is formed as a rigid, one piece molded structure, the handle has a front wall that has a front surface, and the front surface of the handle is configured to extend contiguously with front surface portions of the housing when the handle is in its non-operated position.

4. The latch of claim 3 wherein the housing and the handle are formed from an injection molded, glass reinforced, polycarbonate based polymer blend thermoplastics material.

5. The latch of claim 1 wherein the threaded fasteners include a pair of threaded studs, each having a head formation embedded in the molded material that forms the back wall to provide a rigid connection between the threaded stud means and the back wall, and with the threaded studs each having an elongate rearwardly extending stem with a threaded region that extends rearwardly with respect to the back wall mounting surface and has a threaded region on the stem.

6. A flush-mountable latch having a resilient, expansible latch member that is insertable into a receiving formation of a keeper and is expansible and contractible after being inserted therein to selectively establish latching engagement between the latch member and the keeper, comprising:

(a) housing means including a pan-shaped housing having a front wall, and having recess-defining wall portions that define a forwardly-facing, rearwardly extending recess that opens through the front wall, with portions of the front wall extending about the recess to define a mounting flange that perimetrically borders the recess, and with the mounting flange having rearwardly facing mounting flange surface portions that extend in a common plane for overlying forwardly facing surface portions of a closure or the like on which the housing is to be mounted;

(b) the housing being formed as a rigid, one-piece molded structure, with the recess-defining wall portions including a back wall that is located behind the front wall and that defines a flat, rearwardly facing back wall mounting surface that parallels said common plane;

(c) threaded fastener means rigidly connected to the back wall at locations spaced across the back wall;

(d) handle means including a handle formed as a rigid, one-piece molded structure, with the handle being positioned in the recess and being connected to the housing means for movement relative thereto between nonoperated and operated positions, with the handle having front surface portions that extend substantially contiguously with the front face of the front wall when the handle is in its nonoperated position;

(e) opening means formed through the recess-defining portions, with the opening means including an opening formed through the back wall;

(f) barrel means having front and rear surfaces at opposed ends thereof, having an enlarged head at the front end for defining the front surface, having a threaded barrel shaped portion for extending through the back wall opening, and having a through passage formed therethrough that extends along an axis that is perpendicular to the plane of the back wall;

(g) an elongate, shaft-like shank member extending through the barrel means and having front and rear end regions connected by an enlarged diameter central region with front and rear regions projecting forwardly from the front end of the barrel means and rearwardly from the rear end of the barrel means, respectively, with the enlarged diameter central portion of the shank being of relatively large diameter and extending into the large diameter rearwardly opening end of the through passage;

(h) resilient, expansible latch means including a resilient, expansible latch member that is insertable into a receiving formation defined by a keeper, and that is expandable and contractible after being inserted into the receiving formation to establish or relinquish latching engagement between the latch member and the keeper, and with the latch member having first and second end regions that are movable relatively toward and away from each other to effect said expansion and contraction of the latch member, with the first end region being located forwardly with respect to the rear end region, with the rear end region being drivingly connected to the shank for movement relatively toward and away from the front end region to effect said expansion and contraction of the latch member in response to forward and rearward movements of the shank, and with the front end region being connected to the housing and being relatively immovable with respect to the housing whereby, when the handle pivots to effect forward or rearward movement of the shank, such forward or rearward movement is imparted to the rear end region of the expansible member to either expand or contract the expansible member by moving its front and rear end regions relatively toward or away from each other.

7. The latch of claim 6 additionally including bracket means interconnecting the housing and the front end region of the resilient, expansible latching member for positioning the front end region of the latching member at a location spaced behind the rear wall of the housing.

8. The latch of claim 7 wheren aligned holes are formed through the bracket and through the back walls of the housing, the shank is inserted through the aligned holes, and the handle operates on the forward region of the shank to effect forward and reward movements of the shank in response to pivotal movement of the handle with respect to its nested and extended positions.

9. The latch of claim 8 wherein the shank has flat surfaces on opposed sides thereof, and at least one of the aligned holes formed through the bracket has flat surfaces therein that engage the flat surfaces on the shank to prevent shank rotation relative to the bracket.

10. The latch of claim 8 wherein the shank extends through the resilient expansible member from the front end region thereof to the rear end region thereof, with the rear end region being threaded onto a threaded portion of the shank, and with the front end region being slidably movable with respect to the body of the shank.

11. The latch of claim 10 wherein a locking nut is threaded onto the threaded end region of the shank at a location behind the rear end of the resilient, expansible latching member, with the locking nut being tightened into firm engagement with the rear end region of the locking member to prevent relative rotation between the locking member and the shank.

12. The latch of claim 6 wherein the handle is pivotally connected to the forward end region of the shank for movement between a nested position wherein the handle is nested within the forwardly facing housing recess, and an extended position where portions of the handle project forwardly from the housing recess, with the handle being rotatable with the shank about the axis of the of the shank when the handle is in its extended position between latched and unlatched positions;

(a) locking means including a locking member for engaging the shank to prevent relative rotation between the shank and the housing, and for preventing relatively axial movement of the shank with respect to the housing when the locking member is in its locked position; and, (b) means for movably mounting the locking member on the housing for movement between said locked position and an unlocked position wherein the locking member is out of engagement with the shank.

13. The latch of claim 12 wherein the locking means additionally includes a plug member that is mounted for rotation relative to the housing between locked and unlocked positions, with the plug member having a locking formation thereon for connection to the locking member to effect movement of the locking member between its locked and unlocked positions in response to rotation of the plug between locked and unlocked positions.

14. The latch of claim 12 wherein:

(a) the locking member is a one-piece metal stamping having a central portion that engages the back wall mounting surface and is slidable therealong; and, (b) the locking member has an offset portion that is formed as an integral part of the stamping and that extends rearwardly from the back wall mounting surface for defining a slot that is movable into and out of engagement with a pair of flat surfaces formed on the shank when the locking member is in its locked position, and that is blocked by the locking member from moving, and immovable out of engagement with the flat surfaces when the locking member is in its unlocked position.

15. The latch of claim 14 wherein the locking member has elongate slot means including a pair of spaced elongate slots formed through the central portion for receiving the elongate shanks of the threaded stud means and cooperating therewith to slidably mount the locking member on the housing for movement between its locked and unlocked positions.

16. The latch of claim 6 wherein:

(a) the housing has a generally cylindrical sleeve-like portion formed integrally with the front wall and defining a through passage that opens through the front wall, with the through passage having an inner wall surface that is of generally cylindrical configuration and extends concentrically about an imaginary axis that extends substantially perpendicularly to the common plane of the rearwardly facing mounting flange surface portions;

(b) at least one groove is formed in the inner wall surface of the through passage;

(c) a plug is configured to fit within the through passage and is journaled therein for rotation about the imaginary axis;

(d) an offset projection is connected to the plug and extends rearwardly therefrom at a location behind the rear wall of the plug, with at least a portion of the projection being offset from the imaginary axis so as to have a portion of the projection located radially outwardly beyond the inner wall of the passage; and, (e) the plug being insertable into the passage and with withdrawble therefrom only when the offset projection is in alignment with the groove so as to pass through the groove as the plug moves through the passage.

17. The latch of claim 16 wherein the locking member has a projection receiving formation that engages the rearwardly extending offset projection to drivingly interconnect the plug and the locking member so that the locking member is moved between its locked and unlocked positions in response to rotary movement of the plug between its locked and unlocked positions.

18. The latch of claim 17 wherein the inner cylindrical surface has at least one groove formed therein to receive tumblers of a key-operated locking plug to lock the locking plug against rotation, and the plug includes key-ooperated locking means that is responsive to the insertion of a key therein for selectively permitting and preventing rotation of the locking plug between locked and unlocked position.

19. The latch of claim 6 wherein:

(a) the handle has mounting formation means that includes a pair of spaced mounting portions that extend along opposite sides of the front end region of the shank;

(b) an elongate pin extends through aligned holes formed through the spaced mounting portions and through the front end region of the shank for pivotally connecting the handle and the shank to permit movement of the handle between its nested and operating positions; and, (c) first and second stop formations are provided on the mounting portions for engaging the front surface of the barrel means when the handle is in its nested and extended positions, with the first stop formation engaging the front surface of the barrel means when the handle is nested, and with the second stop means engaging the front surface of the barrel means when the handle is extended, and with the first and second stop formation means extending at substantially right angles with respect to each other.

20. The latch of claim 19 additionally including auxiliary stop means formed on the handle for engaging the back wall of the housing when the handle is in its nested position.

21. The latch of claim 6 wherein:

(a) the barrel means has a front surface, a back surface, an enlarged head portion defining the front surface, an elongate barrel-shaped portion that extends from the head to the back surface, a relatively small diameter hole opening through the front surface, a relatively large diameter hole opening through the back surface and extending through the barrel portion along said common axis and having a radially extending end wall that is located near the head portion and provides a transition between the relatively small diameter hole and the relatively large diameter hole that opens through the front and rear surfaces, respectively;

(b) the shank means has a relatively large diameter central portion thereon that has an outer diameter which slip-fits within the relatively large diameter hole and which is positioned to extend into the relatively large diameter hole, with the front end region of the shank extending through the remainder of the barrel and through the relatively small diameter opening for pivotal connection to the handle means; and, (c) biasing means housed within the barrel and interposed between the end wall and the relatively large diameter portion of the shank means for biasing the shank means rearwardly along the axis.

22. The latch of claim 21 wherein:

(a) when the handle is nested, the relatively large diameter central portion of the shank is housed entirely within the large hole of the barrel;

(b) when the handle is in its extended position, the relatively large diameter central region of the shank projects out of the barrel; and, (c) the locking member is operable to engage the shank at a location immediately behind the back face of the barrel to prevent the enlarged diameter central portion of the shank from moving out of the barrel when the locking member is in its locked position.

23. The latch of claim 6 additionally including:

(a) internally threaded mounting post means connected to the rearwardly extending shanks of the threaded stud means for extending rearwardly from the housing and for defining a pair of threaded surface formations at a location behind the back wall;

(b) U-shaped mounting bracket means having a central wall formation for overlying the housing portions that define the recess, and having a pair of forwardly extending leg formations connected to opposed end regions of the central wall formation, and having a pair of holes provided through the central wall formation in alignment with the threaded surface formations;

(c) threaded fastener means extending through the holes in the central wall formation of the mounting bracket and being threadedly connected to the threaded surface formations of the mounting post means for being tightened into threaded engagement with the mounting posts means to clamp the forwardly extending leg formations of the mounting bracket toward portions of the rearwardly facing mounting flange surface for clamping a member on which the housing is to be mounted between the rearwardly facing mounting flange surface and the forwardly extending formations.

24. The latch of claim 6 wherein the housing additionally hs, formed integrally therewith, a plurality of locator projections that extend rearwardly from the rearwardly facing mounting flange surface at junctures of the rearwardly facing mounting flange surface with recess-defining wall portions.

25. The latch of claim 6 wherein:

(a) the mounting flange of the housing, as viewed from a front side thereof, is of generally rectangular configuration, having two opposed side edges of relatively equal length that are joined by two end edges that are of a substantially equal length that is less tha the lengths of the sides, (b) the rearwardly extending recess, as viewed from a front side thereof, is of generally rectangular configuration;

(c) the portions of the housing that define the rearwardly extending recess serve to locate the recess with respect to the mounting flange such that a relatively wider portion of the mounting flange is located at one end of the recess than is provided at the opposite end of the recess; and, (d) a generally cylindrical sleeve-like housing portion is provided as an integral part of the housing at a location near the one end of the recess and extending rearwardly from the relatively wide mounting flange portion.

26. The latch of claim 25 wherein the cylindrical mounting formation has a generally cylindrical opening formed therein that extends along an imaginary axis that is substantially perpendicular to the plane of the back face of the mounting flange, that opens rearwardly.

27. The latch of claim 26 additionally including a plug-mounting opening that is formed through the front face of the relatively wider portion of the mounting region of the mounting flange and that communicates with the passage that extends through the cylindrical formation.

28. The latch of claim 6 wherein the handle is of generally L-shaped configuration and has a relatively wide operator engageable formation extending across one end region of the recess when the handle is in its nested position, and has a relatively thin connecting portion that interconnects the operator engageable formation and the mounting formation, and that extends along one side of the recess when the handle is in its nested position.

29. A flush-mountable latch, comprising:

(a) housing means including a pan-shaped housing having a front wall, and having recess-defining wall portions that define a forwardly-facing, rearwardly extending recess that opens through the front wall, with portions of the front wall extending about the recess to define a mounting flange that perimetrically borders the recess, and with the mounting flange having rearwardly facing mounting flange surface portions that extend in a common plane for overlying forwardly facing surface portions of a closure or the like on which the housing is to be mounted;

(b) the housing being formed as a rigid, one-piece molded structure, with the recess-defining wall portions including aback wall that is located behind the front wall and that defines a flat, rearwardly facing back wall mounting surface that parallels said common plane;

(c) threaded fastener means rigidly connected to the back wall at locations spaced across the back wall;

(d) handle means including a handle formed as a rigid, one-piece molded structure, with the handle being positioned in the recess and being connected to the housing means for movement relative thereto between non-operated and operated positions, with the handle having front surface portions that extend substantially contiguously with the front face of the front wall when the handle is in its non-operated position;

(e) opening means formed through the recess-defining portions, with the opening means including an opening formed through the back wall;

(f) barrel means having front and rear surfaces at opposed ends thereof, having an enlarged head at the front end for defining the front surface, having a threaded barrel shaped portion for extending through the back wall opening, and having a through passage formed therethrough that extends along an axis that is perpendicular to the plane of the back wall;

(g) an elongate, shaft-like shank member extending through the barrel means and having front and rear end regions connected by an enlaged diameter central region with front and rear regions projecting forwardly from the front end of the barrel means and rearwardly from the rear end of the barrel means, respectively, with the enlarged diameter central portion of the shank being of relatively large diameter and extending into the large diameter rearwardly opening end of the through passage;

(h) a resilient, expansible member having first and second end regions with the first end region being located forwardly with respect to the rear end region, with the rear end region being drivingly connected to the shank for forward and rearward movements in response to corresponding forward and rearward movements of the shank, and with the front end region being connected to the housing and being relatively immovable with respect to the housing whereby, when the handle pivots to effect forward or rearward movement of the shank, such forward or rearward movement is imparted to the rear end region of the expansible member to either expand or contract the expansible member by moving its front and rear end regions relatively toward or away from each other;

(i) the barrel means has a front surface, a back surface, an enlarged head portion defining the front surface, an elongate barrel-shaped portion that extends from the head to the back surface, a relatively small diameter hole opening through the front surface, a relatively large diameter hole opening through the back surface and extending through the barrel portion along said common axis and having a radially extending end wall that is located near the head portion and provides a transition between the relatively small diameter hole and the relatively large diameter hole that opens through the front and rear surfaces, respectively;

(j) the shank means has a relatively large diameter central portion thereon that has an outer diameter which slip-fits within the relatively large diameter hole and which is positioned to extend into the relatively large diameter hole, with the front end region of the shank extending through the remainder of the barrel and through the relatively small diameter opening for pivotal connection to the handle means; and, (k) biasing means housed within the barrel and interposed between the end wall and the relatively large diameter portion of the shank means for biasing the shank means rearwardly along the axis, and the biasing means includes a compression coil spring that extends about the front end region of the shank, with the spring having a front end region that engages the end wall, and having a rear end region that engages the enlarged diameter portion of the shank.

30. The latch of claim 29 wherein resilient seal means carried on the front end region of the shank and is interposed between the shank and the housing for preventing unwanted moisture from traveling through the passage.

31. A flush-mountable lock having a resilient, expansible latch member that is insertable into a receiving formation of a keeper and is expansible and contractible after being inserted therein to selectively establish latching engagement between the latch member and the keeper, comprising:

(a) pan-shaped housing with a forwardly facing recess surrounded by a mounting flange that has a front face and a rear face, with the housing also having a locking plug mounting location defined adjacent of the recess by means of a generally sleeve-like structure which has a through passage that opens through the front face of the mounting flange;

(b) the housing being formed as a one-piece structure from injection molded plastics material and having a back wall at the rear of the forwardly facing recess, with the back wall closing the rear of the recess, and defining a flat mounting surface on the back of the housing, with a pair of threaded mounting studs having portions embedded in the material of the back wall and having threaded stud portions that project rearwardly from the back wall;

(c) handle means including a handle that is pivotally connected to the housing and that is pivotally movable relative to the housing between a non-operated position and an operated position;

(d) an opening formed through the back wall;

(e) handle-connected means extending through the opening for connection to the handle and for being moved in response to movement of the handle between its non-operated and operated positions, including an elongate shaft-like shank that is connected to the handle and extends through the back wall and that is connected to the housing for axial movement along the axis of the shank in response to pivotal movement of the handle; and, (f) resilient, expansible latch means including a resilient, expansible latch member that has a latching formation having first and second portions that are movable relatively toward and away from each other to effect expansion and contraction of the latch member, with the first of the relatively movable portions being connected to the housing means, and with the second of the relatively movable portions being connected to the shank for movement toward and away from the first of the relatively movable portions in response to movement of the shank in response to movement of the handle between its non-operated and operated positions to effect expansion and contraction of the latching formation in response to handle movement, and with the latching formation being insertable into a receiving formation that is defined by a keeper, with the latching formation being selectively expansible and contractible after being inserted into the receiving formation to releasably grip the keeper so as to selectively establish and release latching engagement with the keeper in response to said movment of the handle between its non-operated and operated positions.

32. The latch of claim 31 wherein the front wall has a front surface that extends in a smooth convex curve, with the thickness of the front wall portions that define the mounting flage differing across the front wall, with maximum thickness being provided where the front wall portions join with the recess-defining wall formations, so as to form strong junctures between the front wall and the recess-defining wall formations all along the juncture of the recess-defining wall formation with the front wall.

33. The latch of claim 32 wherein the handle is formed as a rigid, one piece molded structure, the handle has a front wall that has a front surface, and the front surface of the handle is configured to extend contiguously with front surface portions of the housing when the handle is in its non-operated position.

34. The latch of claim 33 wherein the housing and the handle are formed from an injection molded, glass reinforced, polycarbonate based polymer blend thermoplastics material.

* * * * *